United States Patent [19]

Eheim

[11] Patent Number: 4,665,872

[45] Date of Patent: May 19, 1987

[54] REGULATOR APPARATUS FOR A FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 375,415

[22] Filed: May 6, 1982

Related U.S. Application Data

[63] Continuation of Ser. No. 81,291, Oct. 2, 1979, abandoned.

[30] Foreign Application Priority Data

Oct. 17, 1978 [DE] Fed. Rep. of Germany ..... 2845139

[51] Int. Cl.[4] ..... F02M 39/00

[52] U.S. Cl. ..... 123/357; 123/449; 310/36

[58] Field of Search ..... 123/357–359, 123/449, 503, 494; 310/36, 39

[56] References Cited

U.S. PATENT DOCUMENTS

| | | | |
|---|---|---|---|
| 3,515,915 | 6/1970 | Stein | 310/39 |
| 3,539,845 | 11/1970 | Stcherbatcheff | 310/36 |
| 3,661,130 | 5/1972 | Eheim | 123/359 |
| 3,973,539 | 8/1976 | Jones | 123/359 |
| 4,160,177 | 7/1979 | Ascoli | 310/36 |

*Primary Examiner*—Carl Stuart Miller

*Attorney, Agent, or Firm*—Edwin E. Greigg

[57] ABSTRACT

A rotary magnet having a transducer for fuel regulation of a fuel injection pump which requires a minimum of structural space while having a maximum of adjustment force.

5 Claims, 4 Drawing Figures

REGULATOR APPARATUS FOR A FUEL INJECTION PUMP

This is a continuation of application Ser. No. 81,291, filed Oct. 2, 1979, now abandoned.

BACKGROUND OF THE INVENTION

The invention relates to a regulator apparatus for a fuel injection pump. In a known regulator apparatus of the type of this invention, the armature is arranged between two coils disposed on a core, so that, as a result, a considerable structural space is required. It is a prerequisite to the incorporation of electrical regulators in fuel injection pumps that their housing dimensions may not exceed those of the hydraulic or mechanical regulators that have already been utilized. Given the required compact structure, the rotary angle transducer must also be accommodated in a satisfactory manner. In addition, for safety purposes, the rotary magnet must have a minimum adjustment force. In the known rotary magnet system, the dimensions required do not permit the necessary adjustment force to be attained and the resultant coil and system dimensions are insufficient.

OBJECT AND SUMMARY OF THE INVENTION

The regulator apparatus constructed in accordance with the invention has the advantage over the prior art in that a problem-free housing in a given structural space is permitted, the adjustment force is practically doubled, while the transducer is accommodated in an extremely favorable and easily mounted manner. The rotary magnet according to the invention makes possible the combining of various transducers, already known in principle.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
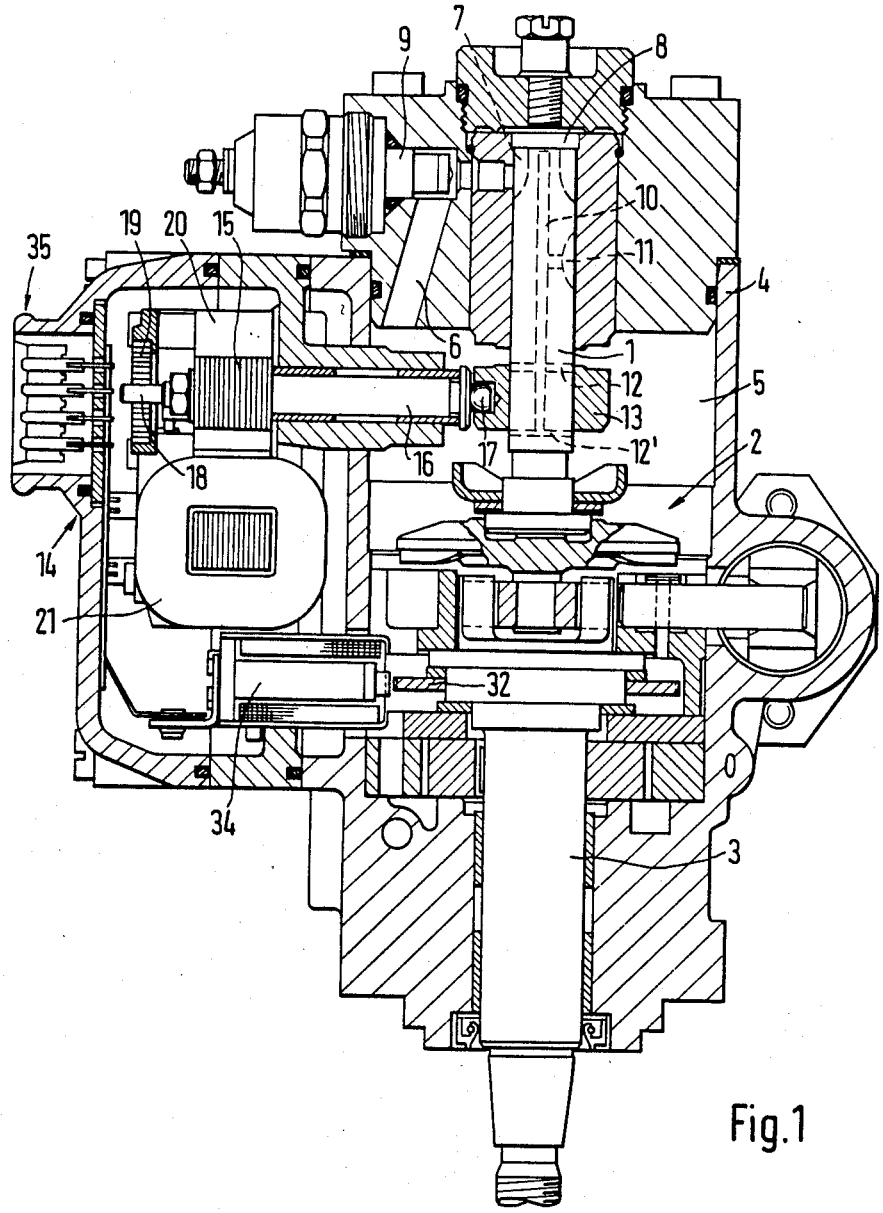
FIG. 1 is a vertical sectional view of one embodiment of a pump and regulator constructed in accordance with the invention.

As is indicated in FIG. 1, a pump piston 1 is actuated by a cam drive 2 and a drive shaft 3 into a simultaneously reciprocating and rotating motion. From a suction chamber 5 provided in the housing 4 of the pump, a pump work chamber 8 is supplied with fuel during the return stroke of the pump piston 1 via a suction duct 6 and longitudinal grooves 7 disposed in the surface of the piston 1. The suction duct 6 is controlled by a magnetic valve 9, which closes the suction duct 6 in case the electrical power fails. The magnetic valve 9 is thus closed in the absence of electric power and is shown in FIG. 1 in the work position. During the compression stroke of the pump piston 1, the fuel enters a distribution groove 11 via a central bore 10 and the distribution groove 11 opens each of the pressure ducts leading to the internal combustion engine, one after another, once per compression stroke.

The central bore 10 has a cross bore 12, which after a certain stroke distance has been covered, emerges from a ring slide 13 and so produces a connection between the pump work chamber 8 and the suction chamber 5, by which means the injection is ended. The reverse is, however, also conceivable; that is, the injection, as alternatively depicted as cross bore 12', makes a pressure build-up in the pump work chamber 8 possible by entering into the ring slide 13 and so makes possible the initiation of injection. In the first case the quantity control is attained by controlling the end of injection; in the second case, it is attained by controlling the initiation of injection.

The ring slide 13 is displaceable by a rotary magnet 14, by which means the amount of fuel to be injected at a particular time varies. The armature 15 of the rotary magnet is coupled with the ring slide 13 via a shaft 16 supported in the housing 4 and a driver crank 17 disposed eccentrically on the end face of this shaft, so that a rotation of the armature 15, or of the shaft 16 results in a displacement of the ring slide 13. A spiral-shaped return spring 19 engages the end 18 of the shaft 16. The rotary magnet 14 further has a U-shaped core 20 as well as a coil 21 which is disposed in the base of the U as is shown in FIG. 2.

The rotary magnet has an armature 15 having oppositely disposed arms, which are each associated with poles disposed on the jokes 22 of the core 20. The poles each have a partially circular-shaped end face 50 adapted to the rotary movement of the armature 15 and oriented toward the axis of the armature shaft 16, and the arms of the armature 15 have corresponding partially circular-shaped end faces 51 pointing away from the axis of the armature shaft 16. The air gap 52 of the rotary magnet is formed in the conventional manner between the end faces 51 of the arms of the armature 15 on one side and the end faces 50 of the poles on the other. This air gap 52 is conically embodied here; that is, the width d, as the radial spacing between the end faces 50 and 51 in the direction of rotation of the armature 15, varies progressively along the overlap of the end face 51 with the end face 50 at a corresponding rotary position of the armature 15 as shown in broken lines in FIG. 2. To this end, for example, the end face 51 of the arms of the armature 15 does not extend parallel to a circular cylinder, the axis of which coincides with the axis of the armature shaft 16, but rather extends about an axis that is located beside that axis, so that the end face 51 of the arms of the armature extends approximately helically with respect to the axis of the armature shaft 16. The end face 50 of the poles, contrarily, is located parallel to a circular cylinder, the axis of which passes through the axis of the armature shaft 16. With the aid of the conical gap, linearization of the adjusting forces of the rotary magnet is attained.

Figure 2:
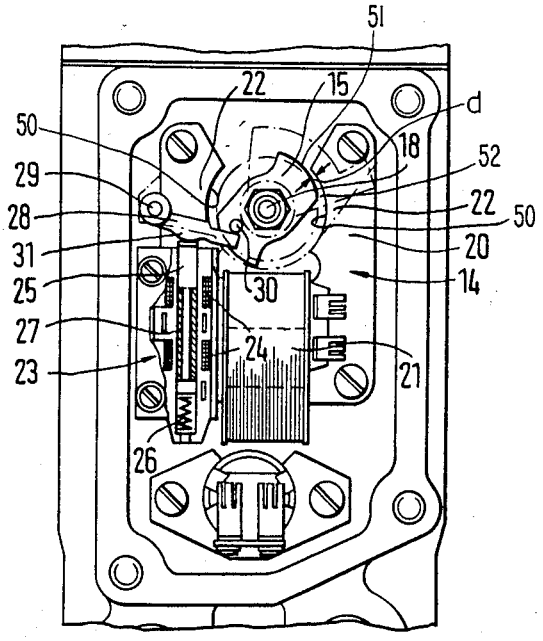
FIG. 2 is a fragmentary view of a portion of the apparatus of FIG. 1 illustrating a first type of transducer.

The rotation of the armature 15 is measured by an inductive transducer, which is disposed, in the first embodiment in FIG. 2, next to the coil 21. In this way, the adjacent cavity that results because of the diameter of the coil 21 is advantageously used, in that the transducer can be secured directly to the core 20. The transducer, indicated by reference numeral 23, operates with two induction coils 24 and a transducer armature 25, which is displaceable by the magnetic armature 15 against a return spring 26. In the area of the induction coils 24, a ferrite core 27 is provided in an annular groove of the transducer armature 25.

The transducer armature 25 can be driven either via a lever directly by the magnetic armature 15, or, as is shown in FIG. 2, it can be driven via a swivelling lever 28, which is supported as indicated at 29 on the core 20 and is swivelled by the armature 15 via a driver tang 30 of the magnetic armature 15. As a result, an optimal adaptation of angle of rotation and stroke can be attained, in particular by means of a curved portion 31 on the contact point.

As is further shown in FIG. 1, the rpm of the pump is measured via a toothed disc 32 driven by the shaft 3 and via a corresponding transducer 34. The electrical data are conducted by wires to and from a plug socket 35. Into this plug socket 35 is placed a plug (not illustrated) which connects the electrical parts of the fuel injection pump with an electronic control device, in which the actual values of the pump as well as other engine characteristics are processed to form setpoint values for the adjustment of the magnet.

Figure 3:
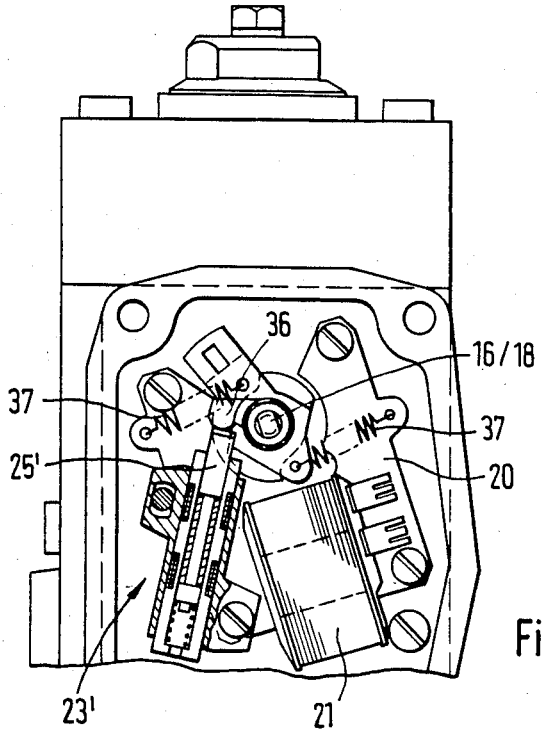
FIG. 3 is a view similar to FIG. 2 illustrating a second type of transducer incorporated in the apparatus of FIG. 1.

In the second embodiment illustrated in FIG. 3, the transducer 23' is designed in the same manner as in the first embodiment of FIGS. 1 and 2. For reasons of space, the rotary magnet is not disposed obliquely, so that the longitudinal plane of the rotary magnet coil 21 and the axis of the transducer 23' enclose, between them, an angle of about 30°. The transducer armature 25' is actuated by a cam-like drive 36, which is directly connected with the shaft 16,18. The return of the rotary magnet is accomplished by two return springs 37 positioned in parallel.

Figure 4:
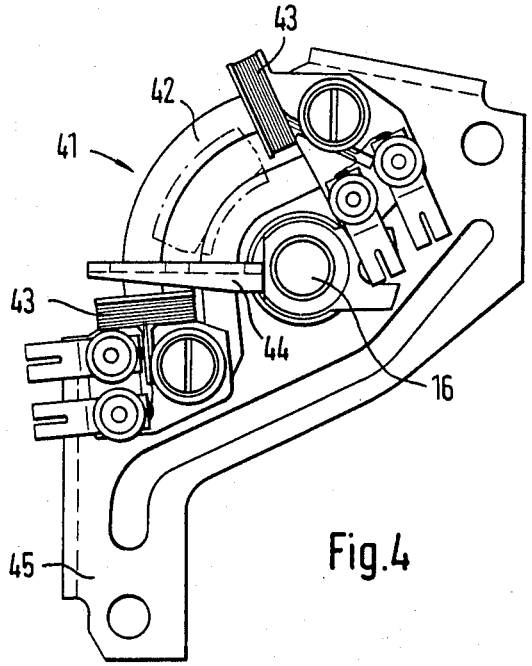
FIG. 4 is a view similar to FIG. 2 illustrating a third type of transducer incorporated in the apparatus of FIG. 1.

The transducer type shown in FIG. 4 is indicated by reference numeral 41. Here a square ring 42 bent to conform to the rotary movement is used as core, on one long side of which, that is, at the beginning and end thereof, the induction coils 43 are disposed. The short-circuit ring 44 is articulated directly from the shaft 16 of the rotary magnet. A plate 45, which supports the transducer 41, (not depicted in further detail) is screwed directly on the core 20 of the rotary magnet. This transducer 41 has, in addition to great precision, an advantageous capacity for detection of the voltage differential in the coils, since the inductance, during displacement of the short-circuit ring 44, varies in one coil in a direction opposite to the inductance of the other coil.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines with a fuel supply quantity regulator apparatus including a pump work chamber and a relief channel therefor, a pump housing, a fuel quantity control element, a rotary magnet system including a rotary magnet shaft having an eccentrically positioned driver disposed in said pump housing as a component part of said quantity control element, which, via said rotary magnet shaft, effects the effective control position of said control element which fixes the beginning or the end of delivery of injection by means of opening said relief channel of the pump work chamber, a return spring secured to said rotary shaft formed by a spiral spring, an inductive transducer coupled to said rotary magnet shaft, said rotary magnet system including a rotary magnet having a U-shaped core (20) including a base and shanks including poles having oppositely disposed circular segmental end faces (50), a magnet coil (21) in the base of said U-shaped core, a rotary armature having oppositely disposed arms having end faces (51) disposed between said core shanks and connected with said rotary magnet shaft, said end faces of said arms of said armature defining together with the end faces of each of said poles for a momentary part of an overlapping of respective end faces a conical air gap (52) which radial width decreases along a circumference defined between the end faces of said arms and poles and wherein said transducer is secured to said core adjacent said coil and positioned relative to said rotary armature for operation by rotation of said rotary armature.

2. A fuel injection pump in accordance with claim 1, wherein said transducer operates on an inductive basis.

3. A fuel injection pump in accordance with claim 2, wherein said transducer functions as a lifting armature transducer, and including a swivelling lever pivotally supported at one end for driving said transducer armature, a driver tang eccentrically connected to said magnet armature for engagement with the other end of said swivelling lever, said swivelling lever being arranged in contact with said transducer armature via a curved portion.

4. A fuel injection pump in accordance with claim 2, including a short-circuit ring having at least one aperture disposed perpendicularly to and connected with said shaft and in the rotary direction a bent core of ferromagnetic material which follows the rotary movement of said shaft protruding through said aperture.

5. A fuel injection pump in accordance with claim 4, wherein said core is formed as a closed square ring, a plurality of coils disposed on said core toward the ends of the travel path of said short-circuit ring, the inductances of which coils varying in opposite directions upon the displacement of said short-circuit ring.

* * * * *